United States Patent [19]

Hauser

[11] Patent Number: 4,770,267

[45] Date of Patent: Sep. 13, 1988

[54] SONAR DOME

[75] Inventor: Jean Luc Hauser, Vence, France

[73] Assignee: Thomson-CSF, Paris, France

[21] Appl. No.: 911,340

[22] Filed: Sep. 25, 1986

[30] Foreign Application Priority Data

Oct. 4, 1985 [FR] France ..... 85 14767

[51] Int. Cl.[4] ..... G10N 11/00; E04B 1/84

[52] U.S. Cl. ..... 181/0.5; 181/175; 181/290; 181/294; 367/1; 367/191

[58] Field of Search ..... 367/1, 141, 150, 152, 367/154, 165, 173, 191; 181/0.5, 122, 140, 198, 294, 175, 290, 148, 153; 174/101.5

[56] References Cited

U.S. PATENT DOCUMENTS

| | | | |
|---|---|---|---|
| 3,038,551 | 6/1962 | McCoy et al. | 367/176 X |
| 3,123,176 | 3/1964 | Greenberg | 367/171 X |
| 3,136,380 | 6/1964 | McCoy et al. | 181/198 |
| 3,426,725 | 2/1969 | Gerhardsen | 367/173 X |
| 3,757,888 | 9/1973 | Lagier et al. | 367/152 X |
| 3,858,165 | 12/1974 | Pegg | 367/173 |
| 4,062,422 | 12/1977 | Phelps, Jr. et al. | 181/198 |
| 4,237,176 | 12/1980 | Brueggemann et al. | 181/294 X |
| 4,307,457 | 12/1981 | Wills | 367/173 |

FOREIGN PATENT DOCUMENTS 2069875 11/1969 France .

*Primary Examiner*—Deborah L. Kyle
*Assistant Examiner*—Brian S. Steinberger
*Attorney, Agent, or Firm*—Cushman, Darby & Cushman

[57] ABSTRACT

A sonar dome having an external wall in which a central layer is formed by a plurality of woven webs of glass fibers impregnated with a resin and by two peripheral layers located on each side of the central layer, the peripheral layers being constituted by a plurality of woven webs of carbon fibers impregnated with a resin.

4 Claims, 1 Drawing Sheet

SONAR DOME

BACKGROUND OF THE INVENTION

1. Field of the Invention

This invention relates to a sonar dome or in other words a dome for protecting the antennas of a hull sonar or a towed sonar.

2. Description of the Prior Art

The antennas of sonar systems have to be mechanically protected against impacts, flow noise, corrosion, and so on. This protection is provided by a hollow or massive dome which must be formed from material having a high mechanical strength and acoustic transparency, at least within the frequency band employed. The term "acoustic transparency" refers to a property of materials in which the specific density is close to that of water and in which the velocity of propagation of sound waves is substantially equal to the propagation velocity in water. The coefficient of transmission of such materials is close to 1.

As disclosed in French patent application No. 2,069,875 filed by the present Applicant, it is already known to construct massive domes of thermosetting polyurethane. Since this material is soft, it use creates the need to construct massive domes which prove unsuitable for enclosed antennas of ellipsoidal or spherical shape since antennas of this type are no longer accessible. Furthermore, in the vicinity of 0° C., the coefficient of acoustic transmission of this material becomes poor. This is an objectionable phenomenon since a waiting period of several hours is sometimes necessary before the material is restored to the water temperature. For the protection of antennas having transducers placed on the surface of a ship's hull, a known type of dome in the form of a shell is made from woven layers of glass fibers that are impregnated with a polyester resin. This material has a modulus of elasticity (defined as the ratio of applied stress to resultant deformation), the value of which being such as to require relatively substantial hull thicknesses. Consequently, this results in poor sound transmission.

Another known composite material consists of carbon fibers impregnated with a resin having a higher modulus of elasticity but entire domes cannot practically be made of this material because of cost constraints. There do exist, however, domes made of glass fibers and polyester resin in which acoustic windows of carbon fibers are formed for the purpose of improving the transmission. These windows are formed of constituted by carbon fibers which are impregnated with polyester resin which replaces part of the thickness of the shell of glass fibers and polyester resin on the inside of the shell. The disadvantage of this structure, however, lies in the fact that it remains heavy and difficult to construct.

SUMMARY OF THE INVENTION

An object of the present invention is to provide a lightweight dome having good acoustic transmission characteristics that is easy to construct. In the preferred embodiment this is accomplished by providing a dome of composite material having a layer of glass fibers and two layers of carbon fibers impregnated with a resin, the layers being combined so as to overcome the above discussed disadvantages of prior art domes.

The distinctive feature of the sonar dome in accordance with the present invention lies in the fact that the dome has an external wall in which a central layer is formed by a plurality of webs of glass fibers impregnated with a resin and by two peripheral layers located on each side of the central layer, said peripheral layers being constituted by a plurality of woven webs of carbon fibers impregnated with a resin.

DESCRIPTION OF THE PREFERRED EMBODIMENT

Figure 1:
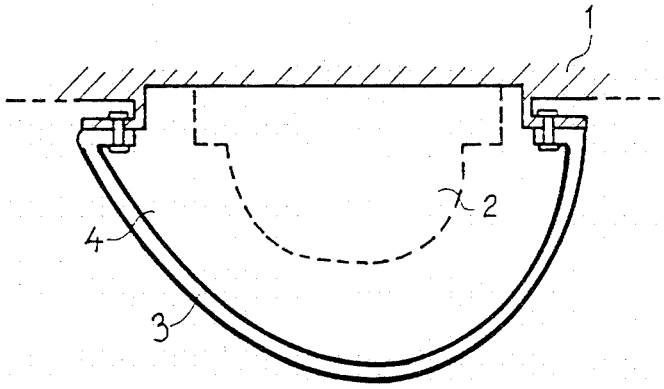
FIG. 1 is a sectional view showing one example of a sonar dome in accordance with the invention.

In FIG. 1, the dome has the shape of a shell, the wall 3 of which is formed in one piece and bolted around its periphery to the hull 1 of a ship. A sonar antenna 2 secured to the ship's hull 1 is located within the hollow interior of the dome and is immersed in water 4 retained by the dome.

Figure 2:
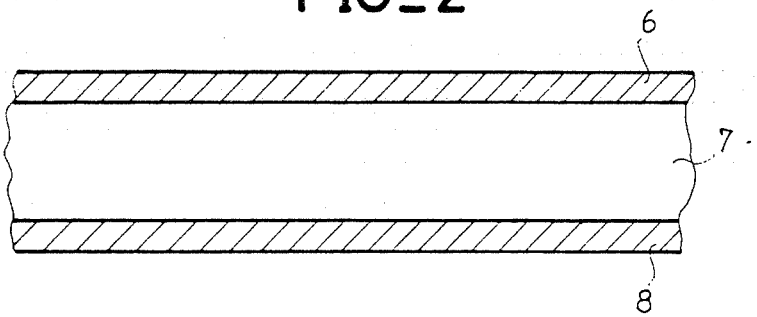
FIG. 2 is an enlarged sectional view showing the wall of this example of construction.

As illustrated in the enlarged sectional view of FIG. 2, the wall 3 has a sandwich structure formed of three layers:

- two peripheral layers 6 and 8 constituted by three woven webs or so-called "folds" of carbon fibers;
- a central layer 7 constituted by eight folds of glass fibers.

The three layers 6, 7 and 8 are impregnated with a thermosetting epoxy resin. During hardening of the resin, these three layers are forced against each other under high pressure and polymerized in an oven. The rise in temperature and pressure involved in this process can be determined by any one versed in the art and varies according to the resin employed.

The central layer 7 has a thickness of 5 mm. The two peripheral layers 6, 8 have identical thicknesses of 1.5 mm. The thicknesses are made identical in order to achieve both mechanical and thermal stability of the material or in other words to prevent any deformations which might arise from mechanical or thermal stresses.

The dome in accordance with the present invention has good acoustic transmission and high flexural strength by virtue of the carbon fibers which are located at a distance from the neutral axis.

Figure 3:
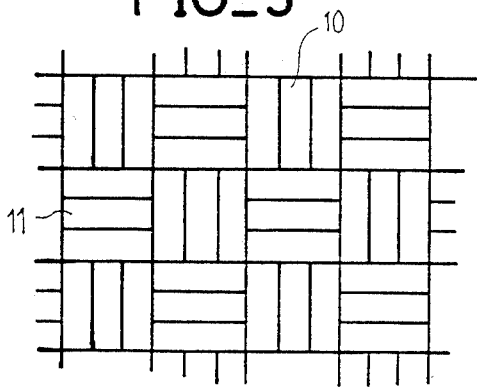
FIG. 3 shows the weave of one of the carbon fiber webs used in the construction of the wall.

FIG. 3 shows an example of weaving of one of the folds of carbon fibers constituting the layers 6 and 8. Slivers of carbon fibers are crossed with an identical pitch such as a pitch 10 of three threads in the transverse direction and a pitch 11 of three threads in the longitudinal direction by reason of the stiffness of the carbon fibers. The weaving operation (not illustrated in the drawings) is carried out on the folds of glass fibers with a ratio of 1/1.

The wall thus formed has a modulus of elasticity in tension of 28 Gigapascals with an acoustic transmission coefficient of 98%. If the dome had been entirely formed of glass fibers and of polyester resin, the thickness required in order to obtain the same resistance would have been 16 mm and would have resulted in a coefficient of transmission in the vicinity of 92%. Furthermore, the weight gain is in a ratio of 2.

The invention is not limited to this example of construction. It is within the capacity of those skilled in the art to employ a type of resin other than epoxy resins, such as a thermoplastic resin, for example.

It is also possible to make use of a different resin in each layer. By way of example, a resin which is particularly well-suited for carbon fibers can be employed in the two peripheral layers and another resin which is particularly suitable for glass fibers can be employed for the central layer.

In an alternative form of construction, the wall of the dome in accordance with the invention can include additional layers of materials having good acoustic transparency such as, for example, an outer layer of aramide fibers impregnated with epoxy resin in order to obtain particularly high impact strength.

What is claimed is:

1. A sonar dome having an external wall comprising:

a central layer having a uniform thickness including a plurality of woven glass webs bound with a first resin; and two peripheral layers located on each side of said central layer, said peripheral layers including a plurality of woven carbon fiber webs impregnated with a second resin, and said peripheral layers each having a thickness that is substantially less than the thickness of said central layer, whereby with an overall wall thickness of 8 millimeters, the wall composition exhibits a modulus of elasticity in tension of 28 gigapascals with an acoustic transmission coefficient of 98%.

2. A sonar dome according to claim 1, wherein the two peripheral layers have an identical thickness.

3. A sonar dome according to claim 1, wherein the three layers are impregnated with the same resin of the epoxy type.

4. A sonar dome according to claim 1, wherein the thickness of each of said peripheral layers is approximately thirty percent of the thickness of said central layer.

* * * * *